United States Patent [19]

Parkins

[11] Patent Number: 4,743,884

[45] Date of Patent: May 10, 1988

[54] POINT TO POINT TELEALARM

[76] Inventor: Cleve L. Parkins, 54 Cunningham Ave., Uniondale, N.Y. 11553

[21] Appl. No.: 936,518

[22] Filed: Dec. 1, 1986

[51] Int. Cl.[4] ..... G08B 25/00

[52] U.S. Cl. ..... 340/297; 340/301; 379/37; 379/156

[58] Field of Search ..... 340/297, 298, 299, 300, 340/301-306, 506; 379/37, 39, 43, 44, 49, 156, 159, 167

[56] References Cited

U.S. PATENT DOCUMENTS 3,990,075 11/1976 Schmitz et al. ..... 340/511

4,392,125 7/1983 Iwata ..... 379/37

*Primary Examiner*—Donnie L. Crosland

*Attorney, Agent, or Firm*—Michael I. Kroll

[57] ABSTRACT

A point to point telealarm is provided which supplies both telecommunications and alarm functions between two fixed points connected by electrical wires. The alarm may be automatic or manual and may be silent at the point of initiation, or loud and blaring. The system protects itself against cut lines by providing both a visual and an auditory alarm when the line is cut. A self-test feature for this capability is also provided. Doors and windows may be protected against unauthorized entry as well.

10 Claims, 4 Drawing Sheets

TRANSMITTING CALL SIGNAL FROM LOCATION "A" TO "B"

SPEECH CIRCUIT

USING ALARM KEY (AK)

LINE CUT CIRCUIT

FORCED ENTRY ALARM CIRCUIT

| SYMBOL | DESCRIPTION |
|---|---|
| 50 250 B/2 | Relay with two separate windings. Numbers in rectangle represent the resistance value in OHMS of each winding. The letter designation is the name of the relay. The number under the letter indicate the amount of the relay contacts assembled on this relay. |
| | Lamp or Indicator |
| | Resistor (R) |
| | Variable Resistor |
| | Transmitter or Microphone |
| | Receiver or Headset |
| | Direct Current (DC) Bell or Buzzer |
| 1 2 | Normally closed switch contacts. Non-locking. Similar to SPST but moveable spring blade returns to normal closed position under own tension when pressure is removed. |
| 1 2 | Normally open switch contacts. Non-locking. Also referred to as key or button. |
| 1 2 (a) 1 2 (b) | (a) Normally closed switch-locking<br>(b) Normally open switch-locking. Locking mean switch must be depressed twice to restore to normal. |
| 1 2 3 | Change over switch contacts. Similar to SPDT. However the moveable spring blade (2) break contact with (3) when operated and make contact with (1), i.e. change over from (3) to (1). When the operating pressure is removed (2) break contact with (1) and remake contact with (3) under its own tension. |
| B1 1 2 | Normally open relay contact. Letter designation indicate to which relay this is associated. Number beside letter indicate numerical position of relay contact. Other numbers represent the contact or spring blades. |
| D1 2 | Normally closed relay contact. |
| | Earth, Positive Potential (+) |
| | Battery, Negative Potential (-)<br>Earth (Ground) indicate that positive terminal of battery is grounded. |

Figure 7

POINT TO POINT TELEALARM

BACKGROUND OF THE INVENTION

The present invention relates generally to the field of telecommunications, and, more specifically, to systems which facilitate flexible telecommunications functions combined with alarm functions.

At the present state of the art, there are wired intercommunication systems used between fixed locations. There are also alarm systems which provide audible and visual indications of unauthorized entry or other emergency situations. These systems operate separately from each other and do not provide any guarantee of system integrity. For example, such systems are easily circumvented by merely cutting the telecommunications lines between the initiating location and the responding location. The separate telecommunications systems and alarm systems tend to be complex, expensive, and difficult to maintain.

SUMMARY OF THE INVENTION

It is, therefore, a primary object of the present invention to provide a point to point telealarm which provides voice telecommunications between two points by means of handsets connected electrically between the locations.

Another object is to provide a point to point telealarm which allows an initiating operator to signal a respondent by simply depressing a call key which activates a bell at the respondents location.

A further object is to provide a point to point telealarm which establishes verbal communications by merely lifting both handsets off their cradle once the call key has been used to signal.

A still further object is to provide a point to point telealarm which allows either party to initiate an alarm by depressing an alarm key. The alarm may be silent at the initiator's end to avoid alerting, for example, a burglar, or it may set off a loud bell to scare the burglar away.

A yet still further object is to provide a point to point telealarm which provides an automatic alarm when unauthorized entry is attempted via, for example, doors and windows. When an alarm, either automatic or manual, is sounded, the respondent cannot turn off, or reset the system, only the initiator can.

A still further object is to provide a point to point telealarm whose integrity is guaranteed by setting off an alarm if the electrical "B" line connecting the locations is cut and providing test switches at both locations to check that this feature is operating.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURE

The FIG. 1 is an electrical schematic diagram of the invention showing the circuitry at both Location A and at Location B. The system is shown in its stand-by configuration with relays B energized and relays D de-energized.

The FIG. 2 is an extract from FIG. 1. It shows how a call signal is transmitted from Location A to Location B. This is accomplished by the operation of the Call Key (CK). Call Key (CK) is shown in the operated mode with CK1 closed and CK2 open.

The FIG. 3 is an extract taken from FIG. 1. It shows the speech (loop) circuit. The Speak Keys SK1 and SK2 at both locations are shown in the operated mode. This occurs when the handsets are lifted.

The FIG. 4 is an extract from FIG. 1. It shows how an emergency alarm signal is transmitted from Location A to Location B. The Alarm Key (AK) at Location A is shown in the operated mode. AK1 and AK4 are closed, AK2 and AK3 are open. When activated AK is locked, transmitting a permanent signal to ring the Bell(s) at Location B. AK may only then be released by the deliberate action of the initiator at A.

The FIG. 5 is an extract from FIG. 1. It shows the line-cut circuit. The B relays are shown in their normal operated (stand-by) mode. If Line B is cut, the B relays release and cause the Line Cut lamps to be lit and the Bells to ring at both locations.

The FIG. 6 is an extract from FIG. 1. It shows the forced entry alarm circuit. The operation of this circuit sounds the alarms at both Locations. In this case both Locations in effect become a respondent Location since the alarms are not activated by a legitimate operator.

The FIG. 7 is a table of symbols used in FIGS. 1 through 6.

DETAILED DESCRIPTION OF THE PREFERRED EMBODIMENTS

The point to point telealarm is best understood by considering its different operating modes one at a time and then examining miscellaneous systems comments.

General: Reference to FIG. 7, together with the Legend of FIG. 1, define symbols and acronyms used in the Figures numbered 1 through 6. There are three key type switches at both Location A and Location B: the Call Keys, labelled CK, the Speak Keys, labelled SK, and the Alarm Keys, labelled AK. The contacts of each key are numbered sequentially: CK1 to CK2, SK1 to SK5, and AK1 to AK4. Each location also has two relays, labelled B Relay and D Relay and the contacts for each are labelled B1 and B2 and D1 to D3.

The Point to Point Telealarm is an electrical device that provides three communications features, namely voice and data communication and emergency alarm facilities between two designated locations.

Figure 1:
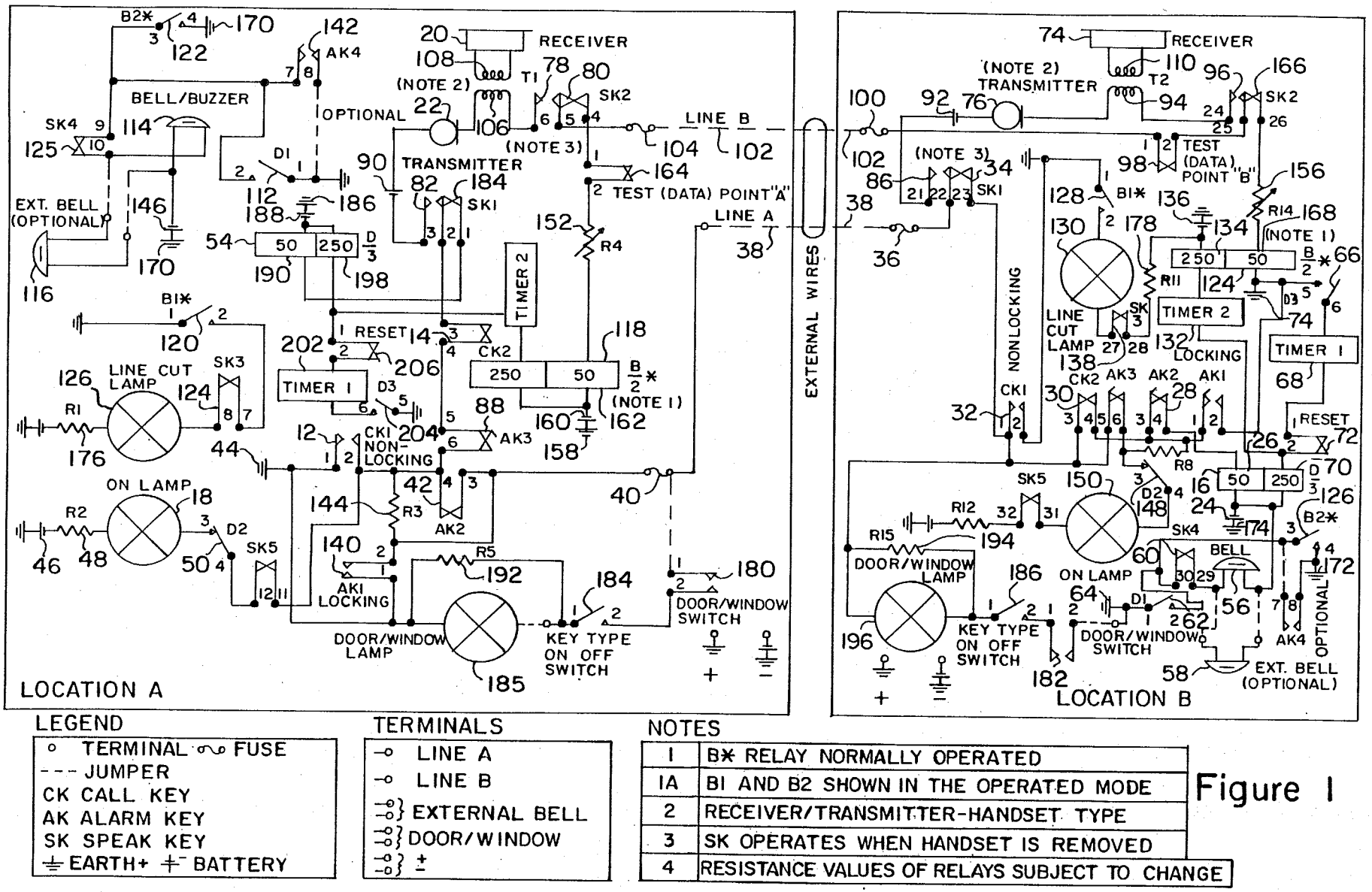

FIG. 1 shows how this is accomplished. To minimize the response time in emergency situations when personal assistance is required, the recommended distance between locations should not exceed five miles. However this distance may be increased depending upon the available power supply.

Figure 2:
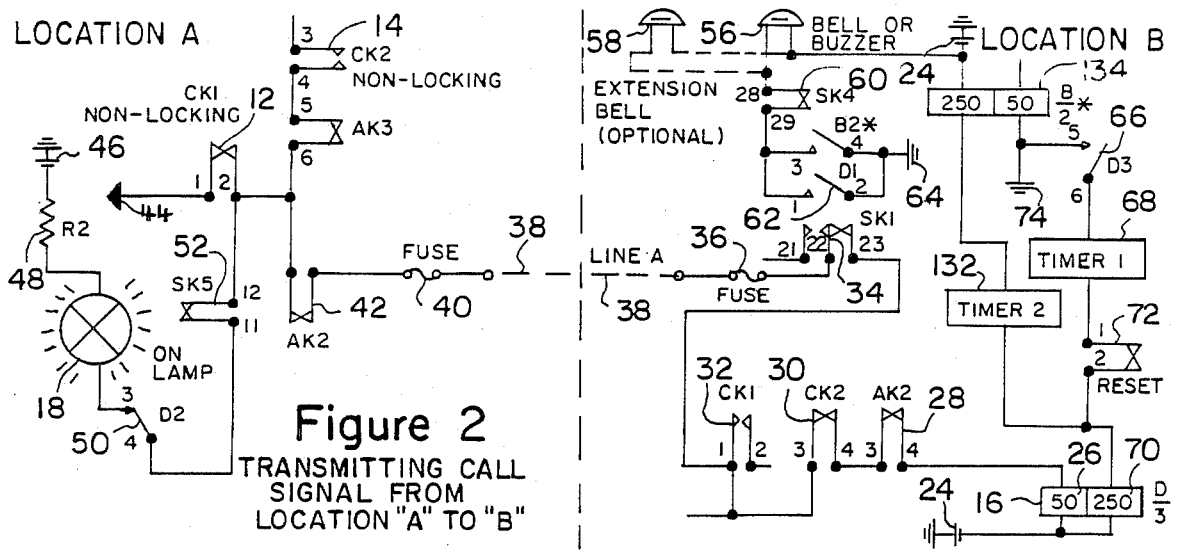

Signalling is best understood with reference to FIGS. 1 and 2. To send a call signal from location "A" to location "B" Call Key (CK) is depressed momentarily, then released. FIG. 2 shows CK in the operated mode. CK1 contacts (12) close and CK2 contacts (14) open. CK1 and CK2 contacts are constructed as one switch assembly so that they operate reciprocally. CK1 contacts (12) complete the circuit for the operation of the D relay (16) at Location B and light the "ON" lamp (18) at location A. After operating CK at location A, the handset comprising receiver 20 and transmitter 22 is lifted to listen for a forthcoming response. The D relay 16 at Location B operates via the following circuit loop: negative potential (battery) 24, 50 ohm winding 26, AK2 contact(28), CK2 contact(30), CK1 contact (32), SK1 contact (34), fuse 36, Line A 38, fuse 40, AK2 contact (42),CK1 contact (12), and positive potential (earth) 44. The "ON" lamp 18 at Location A is lit via the following circuit loop: battery 46, resistor R2 48, lamp 18, D2 relay contact (50), SK5 contact (52) CK1 contact (12), and earth 44. CK2 contact (14) opens and prevents the D relay 54 at Location A from operating. When CK is released, CK1 contact (12) and CK2 contact (14) return to the normal position as shown in FIG. 1.

Operation of D relay at Location B. When D relay 16 at Location B is energized as described above, bell 56 rings via the following circuit loop: battery 24, bell 56 (also external bell 58, SK4 contact 60, D1 relay contact (62), and earth 64. D3 relay contact 66 closes, starts timer #1 68 and holds D relay 16 energized according to the following circuit loop: battery 24, 250 ohm winding 70, reset key (switch) 72, timer #1 68, D3 relay contact (66), and earth 74. When CK at Location A was released, the operating path through the 50 ohm winding 26 of D relay 16 at location B was "open" at CK1 contact (12). The D relay 16 would release, but the D3 relay contact 66 prevents this from happening by maintaining an earth for the hold circuit through the 250 ohm winding 70.

Response by party at Location B. On hearing the bell 56, party B responds by operating the reset key 72 and then lifts the handset to speak. When the reset key is operated, it disconnects timer #1 68 and the hold circuit for the D relay 16 resulting in the release of D relay 16. D1 relay contact (62) opens and stops the bell(s) 56 and 58 from ringing. D3 relay contact (66) opens and prevents D relay 16 from continuing to operate after reset key 72 is released. Both Party A and Party B are now able to converse.

No response from Location B. When D relay 16 operates, D3 relay contact 66 closes and triggers timer #1 68 in series with the D relay. If the call is not answered after a predetermined number of seconds, determined by the timing interval of timer #1 68, the timer will perform the function of the reset key and open the hold circuit of the D relay 16 which will then release. D1 relay contact 62 opens and stops the bell(s) 56 and 58 from ringing. D3 relay contact opens and disconnects the hold circuit of D relay 16.

Figure 3:
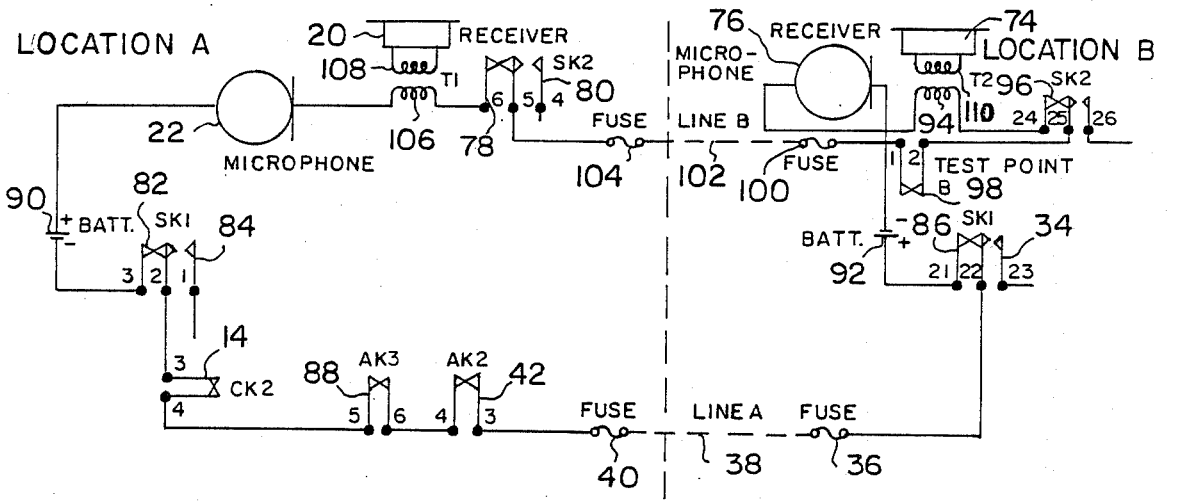

The Speech Circuit is best understood with reference to FIGS. 1 and 3. It is assumed that Party A has been listening at his receiver 20 for a response after signalling Party B. The signal has been received by B who is now ready for verbal communications. When Party B lifts his handset, comprised of receiver 74 and transmitter 76, a speech circuit is completed through the speak keys for automatic operation as indicated in FIG. 3. At Location A a removal of the handset results in the operation of the Speak Key (SK). SK2 contacts (78) close as SK2 contacts (80) open. SK1 contacts (82) close as SK1 contacts (84) open. At Location B, removal of the handset results in the operation of the Speak Key. SK1 contacts (86) close as SK1 contacts (34) open. It should be noted that all the SK's are constructed as one assembly. Therefor SK1–SK5 all operate together (see FIG. 1).

Speech is transmitted as follows: (the battery is shown as the source from which the microphone is energized) Battery 90 at Location A, SK1 contact (82), CK2 contact (14), AK3 contact (88), AK2 contact (42), fuse 40, Line A 38, fuse 36, SK1 contact (86), battery 92, microphone 76, primary T2 (94), SK2 contact (96), test point B 98, fuse 100, Line B 102, fuse 104, SK2 contact (78), primary T1 (106), microphone 22, and battery 90. A speech loop is therefore created. Speech currents are induced in the secondary windings of T1 (108) and T2 110 and converted back to sound by the receivers 20 and 74 respectively.

Replacing the handsets at both locations disconnects the speech circuit and restores the device to normal.

Safeguard against false signal—Location A. When the CK key is operated, CK1 contacts (12) close and CK2 contacts (14) open. This prevents the earth 44 at CK1 from operating D relay 54 through AK3 contact (88). Therefore D1 relay contacts 112 remain open and prevent the bells(s) 114 and 116 from ringing.

After the signal is transmitted to location B, the handset is lifted at location A. Removal of the handset operates the SK switch. SK2 contact (80) releases the B relay 118 at Location A since SK2 contacts 80 are now open. B1 contacts 120 and B2 contacts 122 both close. However SK4 contact (125) opens and prevents the bell(s) 114 and 116 from ringing. SK3 contacts (124) open and prevents the "Line Cut" lamp 126 from being lit.

Safeguard against false alarm—Location B. It should be noted that the B relays at both locations are in series and are normally operated. When SK2 contacts (80) at Location A operate and release the B relay 118, the B relay 124 at Location B should also release. However, if the B relay 124 at location B was allowed to release, B2 relay contacts (126) would close and ring the bells 56 and 58 and B1 relay contacts (128) would close and light the "Line Cut" lamp 130. The B relay 124 is therefore kept operated when the D relay 16 operates. This is achieved by the closing of D3 relay contact 66. D3 keeps both the B and D relays operated in parallel via the following circuit: Earth 74, D3 relay contact (66), timer #1 68, reset key 72, timer #2 132, 250 ohm winding 134 on B relay 124, and battery 136. For additional clarification, refering to FIG. 2, when the reset key 72 or timer #1 68 operates, the hold circuit for both B and D relays is disconnected and they release. The B relay 134 along with timer #2 132 is designed to release some predetermined time after the D relay 16 releases. This extra time is required to allow the handset at Location B to be lifted so that SK3 contact (138) and SK4 contact (60) can operate before B1 relay contact (128) lights the "Line Cut" lamp 130 and B2 relay contact (126) rings bells 56 and 58. Note that B1 relay contact (128) and B2 relay contact (126) close when the B relay 124 releases.

Figure 4:
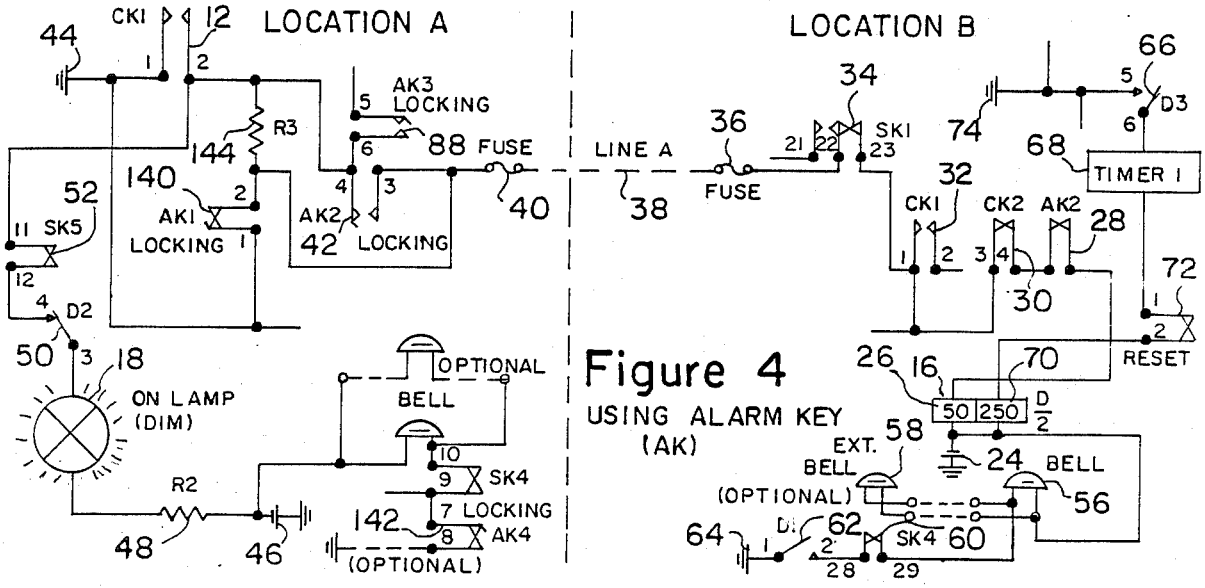

Using the Telealarm in an emergency is best understood with reference to FIGS. 1 and 4. If a party at Location A determines that an emergency situation exists, he can determine whether to use the device to speak or to use it as an alarm. Should he decide to use the device as an alarm because he is unable to speak, or because it is unwise to do so, he operates the Alarm Key, AK.

The AK contacts, AKl, AK2, AK3, and AK4, numerals 140, 42, 88, and 142 respectively, all operate together and lock into position. They can only be jointly released by depressing the Alarm Key a second time. AK1 contact (140) and AK2 contact (42) close and do the following: (a) light the "On" lamp 18 for psychological effect. "On" lamp 18 is lit via the following circuit loop: earth 44, AK1 contact (140), resistor R3 (144), CKl contact (12), SK5 contact (52), D2 relay contact (50), lamp 18, resistor R2 (48), and battery 46. (b) operate D relay 16 at Location B as follows: earth 44, AK1 contact (140), fuse 40, Line A 38, fuse 36, SK1 contact (34), CK1 contact (32), CK2 contact (30), AK2 contact (28), 50 ohm winding 26 of D relay, and battery 24. AK2 contact (42) and AK3 contact 88 open to prevent the operation of D relay 54 at location A. Optional AK4 contacts (142) close and ring bells 114 and 116 via battery 146 if desired.

Operation of D relay—Location B. D1 contact (62) closes and rings bells 56 and 58 as follows: earth 64, D1 relay contact (62), SK4 contact (60), bells 56 and 58, battery 24. See FIG. 4. D2 relay contact (148) (FIG. 1) opens and disconnects the "On" lamp 150 which lit momentarily. D3 relay contact 66 closes and holds D relay 16 operated independent of its 50 ohm winding 26. The hold circuit is: earth 74, D3 relay contact (66), timer #1 68, reset key 72, 250 ohm winding (70) of D relay, and battery 24.

On hearing the bell ringing, the party at Location B attempts to stop it by operating the reset key 72. The reset key 72 opens the hold circuit but D relay does not release because AK1 contact (140) at Location A remains locked and therefore D relay 16 remains in the operated mode through its 50 ohm winding 26. The be11s 56 and 58 continue to ring indicating an emergency. Lifting the handset at Location B will stop the bells from ringing at SK4 contacts (60), if ringing becomes a nuisance. If Party B attempts to speak, however, he will be unable to get a response. The handset is replaced and emergency response action taken. Note: The handset should normally be lifted only if the reset key stop the bells from ringing. If there is no one present at location B, the timer #1 68 will perform the function of the reset key 72 and disconnect the hold circuit of the D relay 16 but it will not release. Therefore, bells 56 and 58 continue ringing. Under this condition, the D relay 16 will only release when AK is released at Location A.

Figure 5:
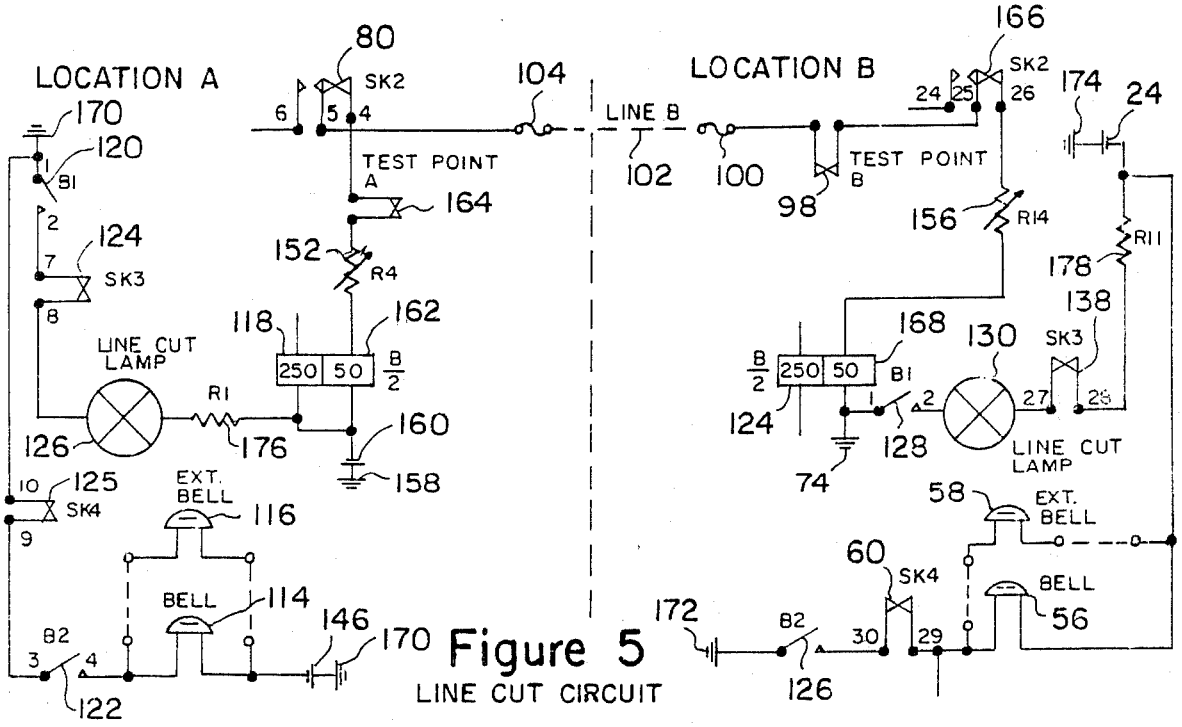

Detecting cut lines is best understood with reference to FIGS. 1 and 5. The normal condition of this device is the permanent operation of the B relay at both locations. If Line B (102) is cut, through an accident or deliberately, the B relays at both locations, 118 at Location A, and 124 at Location B, will release. When B relay releases, B1 relay contacts (120) and 128, and B2 relay contacts (122) and 126 will close. B1 contacts (120) and (128) light "Line Cut" lamps 126 and 130 respectively. B2 contacts (122) and (126) ring bells 114/116 and 56/58 respectively. The "Line Cut" lamp is an indication of the type of alarm. There is therefore no need to attempts talking over the line. Lifting the handset will extinguish the light and stop the bell from continued ringing. When the "Line Cut" lamps 126 and 130 are lit, this should be treated as an energency and previously agreed plans should be put into effect. When the line is restored the circuit will return to normal. Variable resistors R4 (152) and R14 (156) are provided to control the current flow on short lines. The energizing path for the B relays in series is as follows: earth 158, battery 160, 50 ohm relay winding 162, variable resistor R4 (152), test point A 164, SK2 contact (80), fuse 104, Line B 102, fuse 100, test point B 98, SK2 contact 166, variable resistor R14 (156), 50 ohm winding 168, and earth 74. At Location A the closure of B2 relay contacts sets off bells via: earth 170, B2 (122), SK4 (125), bells 114/116, battery (146), earth (170). At Location B, the closure of B2 relay contacts set off bells via: earth 172, B2 relay contact (126), SK4 contact (60), bells 56/58, battery 24, and earth 174. At Location A, the closure of B1 relay contacts lights a "Cut Line" lamp via: earth 170, B1 relay contact (120), SK3 contact (124), lamp 126, resistor R1 176, battery 160 and earth 158. At Location B, the closure of B1 relay contact (128) lights a "Cut Line" lamp via: earth 74, B1 relay contact 128, lamp 130, SK3 contact (138), resistor R11 (178), battery 136, earth 174. The resistance values for the B relay windings are typical values. The operating winding shown in the example, i.e. 50 ohms, should be kept as small as possible in order to increase the distance between locations, i.e. so that line resistance can be higher.

Figure 6:
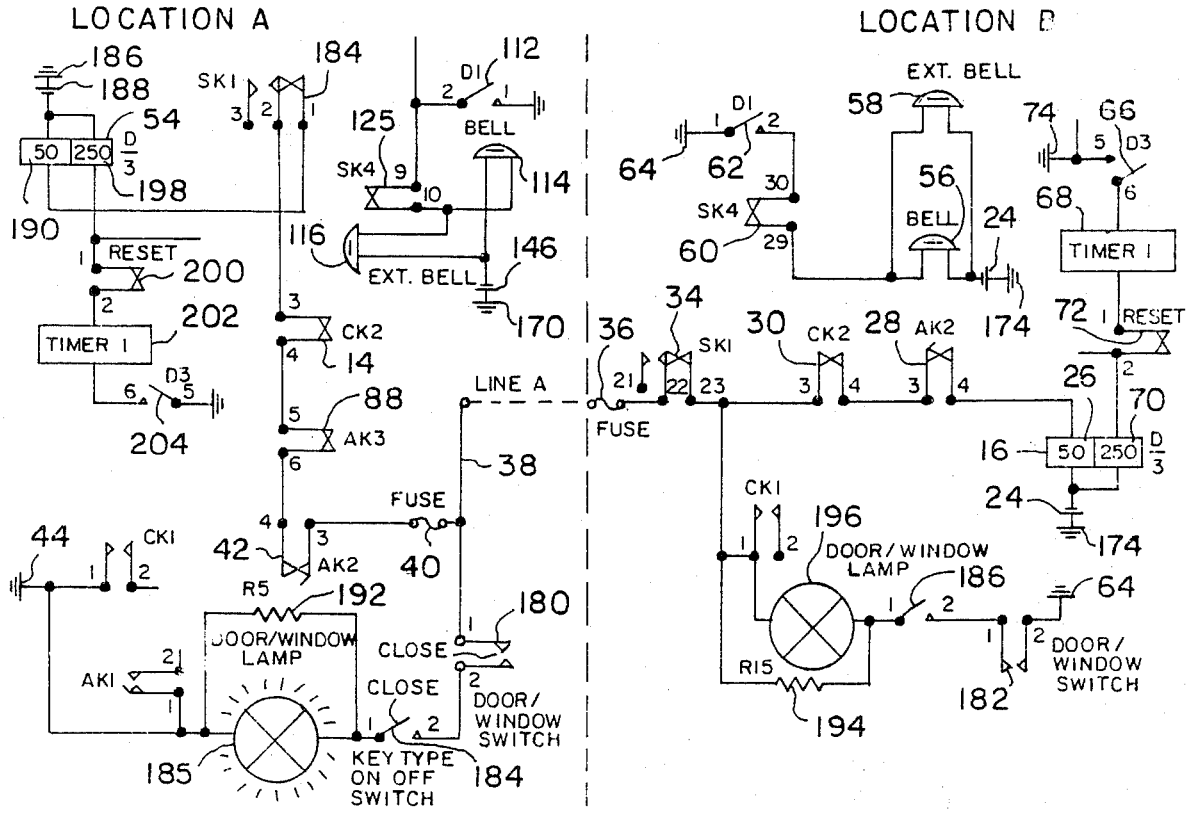

Alarm for forced entry conditions is best understood with reference to FIGS. 1 and 6. If a point of entry such as a door or a window is wired, then if forced entry is attempted at these points, the alarm will be triggered at both locations. The door/window switch 180 at Location A and 182 at Location B are shown with the door/-window closed. 184 and 186 respectively are switches that require a key to operate. If the door is forced open at A, switch 180 will close. This will result in the operation of the D relays 54 and 16 at both locations and the bells will ring and the door/window lamp will be lit at the point of entry. Assume that the point of entry is at location A. Switches 180 and 184 are in the closed position. Current flow to energize the D relay at Location A and light the Door/Window lamp 184 as follows: earth 186, battery 188, 50 ohm winding 190, SKI contact (184), CK2 contact (14), AK3 contact (88), AK2 contact (42), fuse 40, Door/Window switch 180, key switch 184, lamp 185, earth 44. Current flow to energize the D relay 16 at Location B is as follows: earth 44, lamp 185, key switch 184, Door/Window switch 180, Line A 38, fuse 36, SK1 switch (34), CKl/CK2 contact 32/30, AK2 contact (28), 50 ohm winding 26, battery 24, earth 174. Resistors R5 192 in parallel with lamp 185 and R15 194 in parallel with lamp 196 assure the integrity of the alarm circuit should the lamps' filaments become open-circuited. At Location A, a circuit consisting of earth 186, battery 188, 250 ohm winding 198, reset switch 200, timer #1 202 and D3 relay contact (204) keep D relay 54 energized for a predetermined period of time even if the Door/Window (180) switch is restored. It should be emphasized, however, that attempting to use reset switch 72 at Location B will not stop the bells at Location B until the situation at Location A has been corrected. At Location B, a similar circuit consisting of earth 174, battery 24, 250 ohm winding 70, reset switch 72 and timer #1 68, D3 relay contact 66 and earth 74 perform the same function. The operation of the bell circuits has already been described. The glow of the Door/Window lamp warns the respondent to use extra care as danger is imminent.

Data/Testing. The points "A" 164 and "B" 98 allow the line cut features to be tested and data transmitted by coded signalling to distinguish it from the call or alarm signal.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A point to point telealarm comprising:

(a) a handset at each of two locations with control unit;

(b) electrical interconnections between said locations;

(c) an ON lamp at each of said locations;

(d) a bell at each of said locations, (e) a call key at each of said locations, such that when a call key at one location is activated by an initiating operator, said ON lamp at an initiator's location lights and said bell at a respondents location sounds, while said ON lamp at the respondents location is extinguished, thereby alerting said respondent operator that a call has been initiated;

(f) a reset key at each of said locations, such that when said bell is activated at the respondents location by the use of said call key by said initiating operator, said respondent operator being signalled can reset his own bell in preparation for verbal communications;

(g) a speak key at each of said locations, such that when both said initiating operator and said respondent operator lift their respective handsets, said speak keys are activated completing an electrical pathway between said headsets; and, (h) an alarm key at each of said locations whereby said alarm keys lock in a closed position once activated, wherein when said alarm key is activated by an initiating operator, said initiating operator's ON lamp and bell are optionally not activated ensuring a silent alarm; said respondent's bell is activated; and said respondents said reset key is inoperative as respondent's bell will remain activated until said initiating operator un-locks his alarm key.

2. A point-to-point telealarm, as recited in claim 1, further comprising a line cut lamp at each of said locations and wherein said electrical interconnections between said locations include Line B electrical interconnections such that when said Line B electrical interconnections between said locations are cut, at both locations said line cut lamps light and said bells sound.

3. A point to point telealarm, as recited in claim 1 or 2, further comprising one or more door/window switches and a door/window lamp at each location such that when any of said switches are activated by an unauthorized entry at the initiating location: said door/-window lamp lights at the initiating location; said initiating operator's ON lamp is not activated; said initiating location bells are activated; said respondent's bells are activated; and said respondent's said reset key is inoperative as respondent's bells will remain activated until said initiating location operator resets said activated door/window switch.

4. A point to point telealarm, as recited in claim 1, wherein said bells are internally mounted.

5. A point to point telealarm, as recited in claim 1, wherein said bells are externally mounted.

6. A point to point telealarm, as recited in claim 1, further comprising a timing device at each of said locations, such that when said lamp and said bell are activated at the respondents location by the use of said call key by said initiating operator, said timing device automatically de-activates respondents said bells after some pre-determined time.

7. A point to point telealarm, as recited in claim 2, further comprising a B relay; at each of said locations, wherein said B relays are normally kept energized by current flowing through said electrical interconnections between said locations, whereby when said interconnections are cut said line cut lamps and said bells are energized by said B relays.

8. A point to point telealarm, as recited in claim 2, wherein said B relays have dual coils, one of which is used for latching.

9. A point to point telealarm, as recited in claim 2, further comprising a D relay at each of said locations, wherein said D relays are energized by said call keys, said speak keys and said alarm keys, and wherein said D relays have two coils, one of which is used for latching.

10. A point to point telealarm, as recited in claim 1 or 2, further comprising a test/data key at each of said locations such that coded signalling pulses for test purposes as well as for the transmission of data is accomplished by use of the OFF/ON key of said test/data key with the sender's bell/buzzer and line cut lamp being disabled during data transmission.

* * * * *